US012668344B2

(12) United States Patent
Ellis et al.

(10) Patent No.: US 12,668,344 B2
(45) Date of Patent: Jun. 30, 2026

(54) OUTBOARD MOTOR QUICK CONNECT SYSTEM

(71) Applicant: Seamule, LLC, St. Petersburg, FL (US)

(72) Inventors: Cayman Ellis, Madiera Beach, FL (US); Kenny Miller, Madiera Beach, FL (US); Austin Moore, St. Petersburg, FL (US); Robert Andrevich, St. Petersburg, FL (US)

( * ) Notice: Subject to any disclaimer, the term of this patent is extended or adjusted under 35 U.S.C. 154(b) by 415 days.

(21) Appl. No.: 18/509,433

(22) Filed: Nov. 15, 2023

(65) Prior Publication Data

US 2025/0153833 A1 May 15, 2025

(51) Int. Cl.
*F16L 55/115* (2006.01)
*B63H 20/30* (2006.01)
*F01P 3/20* (2006.01)

(52) U.S. Cl.
CPC ..... *B63H 20/30* (2013.01); *F01P 3/205* (2013.01)

(58) Field of Classification Search
CPC ..... B63H 20/30; B63H 20/285; B63H 20/28; F01P 3/205; F16L 55/115; F16L 55/1152; F16L 55/1155; F16L 2201/80; F16L 57/005

See application file for complete search history.

(56) References Cited

U.S. PATENT DOCUMENTS 4,703,914 A * 11/1987 Hoffmann ..... F16L 37/42 251/210
2010/0078265 A1* 4/2010 Drew ..... F01M 11/04 138/89

* cited by examiner

*Primary Examiner* — Aaron M Dunwoody
(74) *Attorney, Agent, or Firm* — Distinct Patent Law; Justin P. Miller

(57) ABSTRACT

The Outboard motor quick connect system allows the user to easily flush an outboard boat motor by combining a permanently-affixed quick-connect fitting with a locking and sealing cap. The combination allows the quick-connect fitting to remain affixed to the motor, but without creating a risk of leaking during operation. The prevention of leaks is important because the flushing connection is part of the boat cooling system. When the boat motor is in operation, an internal pump draws surrounding water up into the motor. If the flushing connection is left open, or leaks, the water drawn in by the pump will be lost, exiting through the flush connection. Thus, while having an easy to access flush connection is important to encourage the user to flush the engine, it is critical that the connection is watertight.

14 Claims, 11 Drawing Sheets

OUTBOARD MOTOR QUICK CONNECT SYSTEM

FIELD

This invention relates to the field of outboard motor flushing and more particularly to a device for simple connection and disconnection of a water flush source.

BACKGROUND

Outboard boat motors use water from the surrounding environment to cool the engine during use. The result is the introduction of contaminants from the environment into the engine. For example, salts and other minerals can be deposited inside the cooling channels of the outboard motor. This contamination results in the reduction of the size of the passages required for cooling the inside of the motor, as well as causing corrosion and degradation of the metals.

To address this issue, outboard motors include a flushing system, or more specifically a port into which freshwater is introduced after the boat is removed from the water. The freshwater rinses out residual salt water and carries away the contaminants. The result is a decrease in salt buildup and corrosion in areas such as the impeller, power head and bearings. The boat motor benefits with increased life and decreased risk of overheating.

Additionally, boat motor manufacturers often require regular flushing to maintain the motor warranty.

But flushing is troublesome. Connecting a hose to the flush port requires rotating the male end of the hose with respect to a fixed female flush port, resulting in a distorted hose and a complicated connection process.

What is needed is a simpler means of connecting a hose for flushing, without creating the risk of leaking during use.

SUMMARY

The Outboard motor quick connect system allows the user to easily flush an outboard boat motor by combining a permanently-affixed quick-connect fitting with a locking and sealing cap. The combination allows the quick-connect fitting to remain affixed to the motor, but without creating a risk of leaking during operation.

The prevention of leaks is important because the flushing connection is part of the boat cooling system. When the boat motor is in operation, an internal pump draws surrounding water up into the motor. If the flushing connection is left open, or leaks, the water drawn in by the pump will be lost, exiting through the flush connection.

Thus, while having an easy to access flush connection is important to encourage the user to flush the engine, it is critical that the connection is watertight.

The Outboard motor quick connect system includes two halves: a first half with a male garden-hose thread (GHT) on one end and a male quick-connect on the other end, and a second half that includes a locking cap with internal seal.

The first half includes the male garden hose threads that interface with the female connection located on the outboard motor. The garden hose threads transition to a quick-connect hose connection.

To connect a hose, a female hose coupler is pressed onto the male connection. An integrated O-ring creates a watertight seal. Once fully inserted, locking balls align with the locking groove and spring outward to lock the connections together. To disconnect, the locking sleeve is pulled back, which allows the locking balls to slide inward and out of the locking groove, releasing the male coupler.

The second half of the Outboard motor quick connect system is the cap. Rather than use the complicated locking ball arrangement of the female hose coupler, the cap includes a recessed O-ring that presses against the end surface of the male protrusion. Two tabs extend from the base of the male connection, passing through slots in the cap. Rotation of the cap locks the female cap over the male connection and maintains compression against the end mounted O-ring of the female cap. The result is a seal that will not vibrate loose and does not require moving parts.

The use of two separate O-rings, one compressed in height against the tip of the hose connection and, and the other compressed circumferentially toward the center of the host connection end, results in a double layer of sealing. This acts as a safety mechanism, reducing the possibility of leaking out of the clean system of the outboard motor, which could result in inadequate cooling of the engine and a motor failure.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
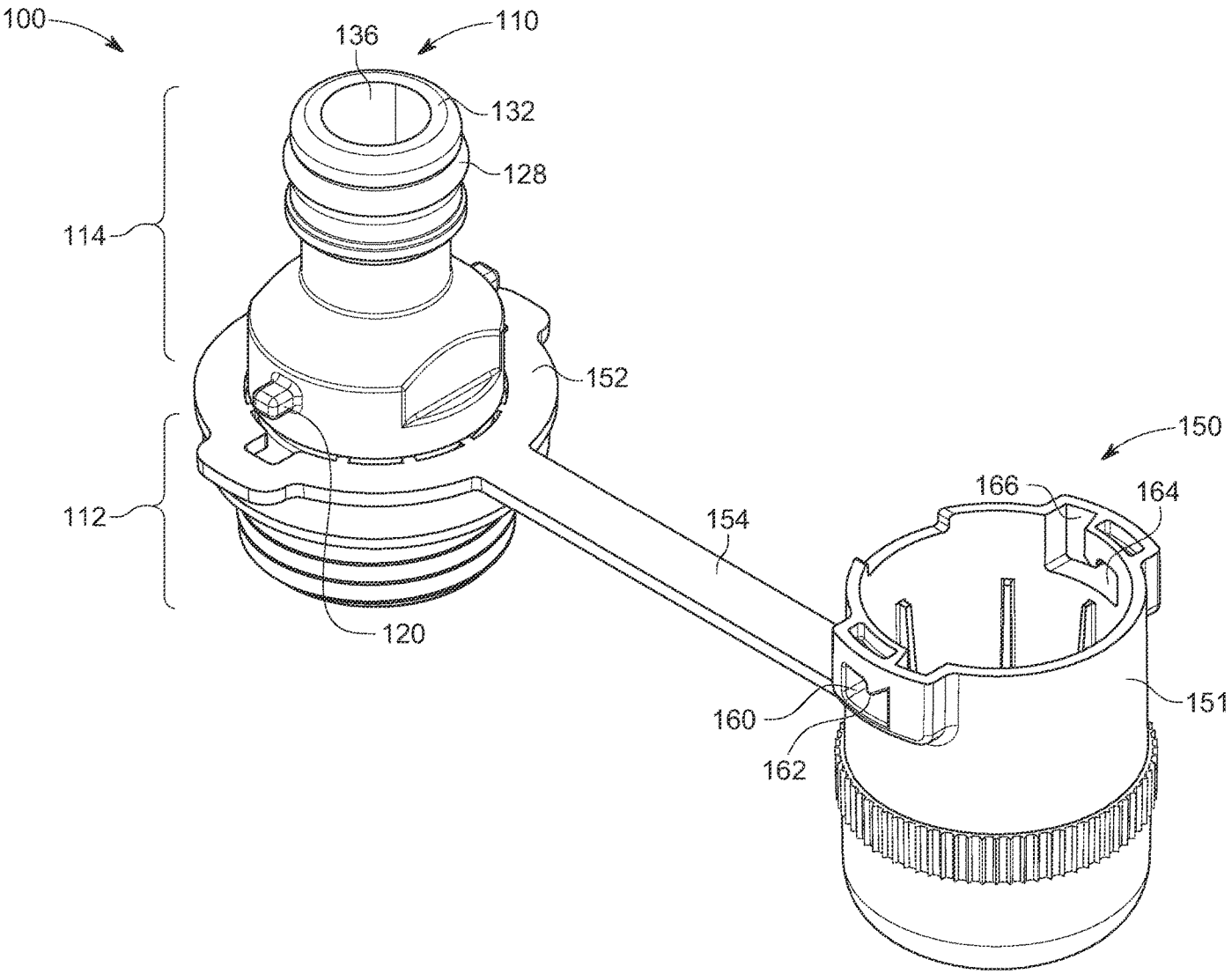
FIG. 1 illustrates a first isometric view of the outboard motor quick connect system.

Reference will now be made in detail to the presently preferred embodiments of the invention, examples of which are illustrated in the accompanying drawings. Throughout the following detailed description, the same reference numerals refer to the same elements in all figures.

Figure 2:
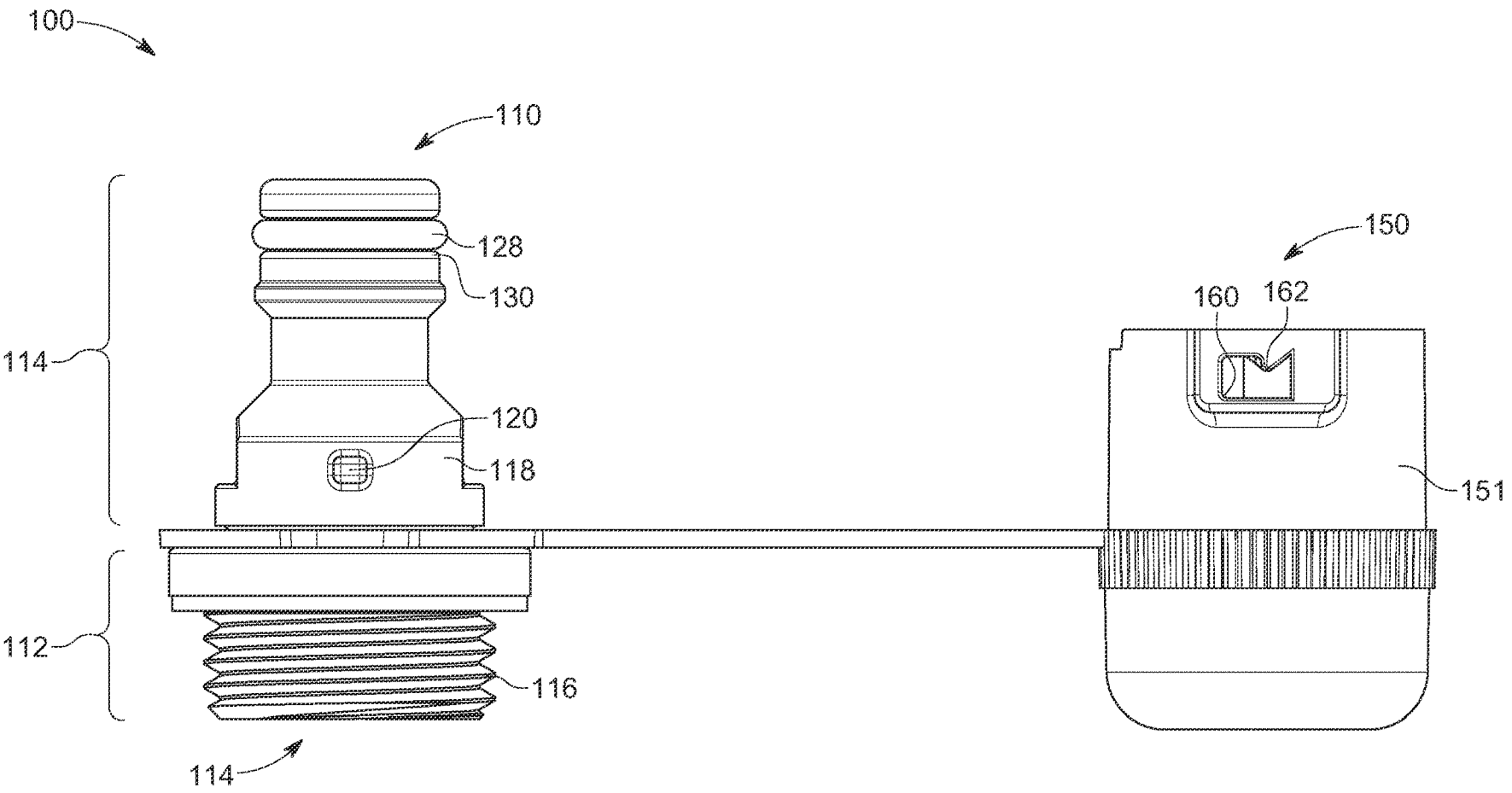
FIG. 2 illustrates a side view of the outboard motor quick connect system.
Figure 3:
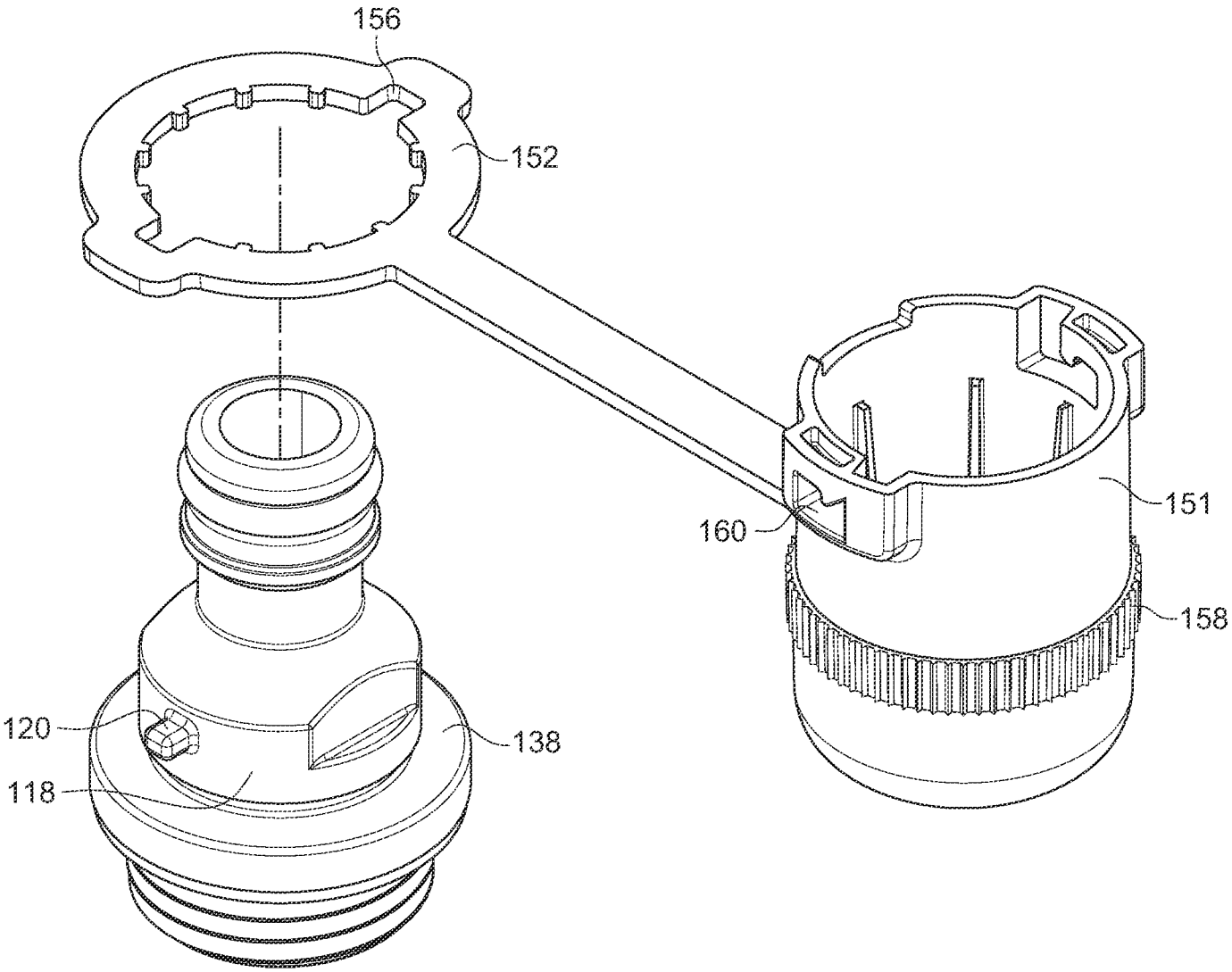
FIG. 3 illustrates a second isometric view of the outboard motor quick connect system.

Referring to FIGS. 1-3, three views of the outboard motor quick connect system are shown.

The outboard motor quick connect system 100 is shown with a water flush connection 110 and cap 150. The cap 150 includes a retaining ring 152 attached to the cap head 151 via retaining leash 154. The retaining ring 152 rests against the shoulder 138 of the body 118.

The water flush connection 110 includes motor connection end 112 and hose connection end 114, through which channel 136 passes. The hose connection end 114 includes the tip 140, around which is a flush connection O-ring 128 set in O-ring groove 130. The upper end of the tip 140 includes a sealing face 132. The motor connection end 112 includes garden hose threads 116.

The body 118 includes tabs 120, which interface with tab slots 160 by passing through groove 166, over tab tooth 162, and into tab retaining recess 164. A secondary function of the tabs 120 is to hold the retaining ring 152 in place, unless slots 156 are lined up to allow the retaining ring 152 to be removed from the water flush connection 110.

Knurling 158 is shown on the outside of cap head 151, helping the user to grip and twist.

Figure 4:
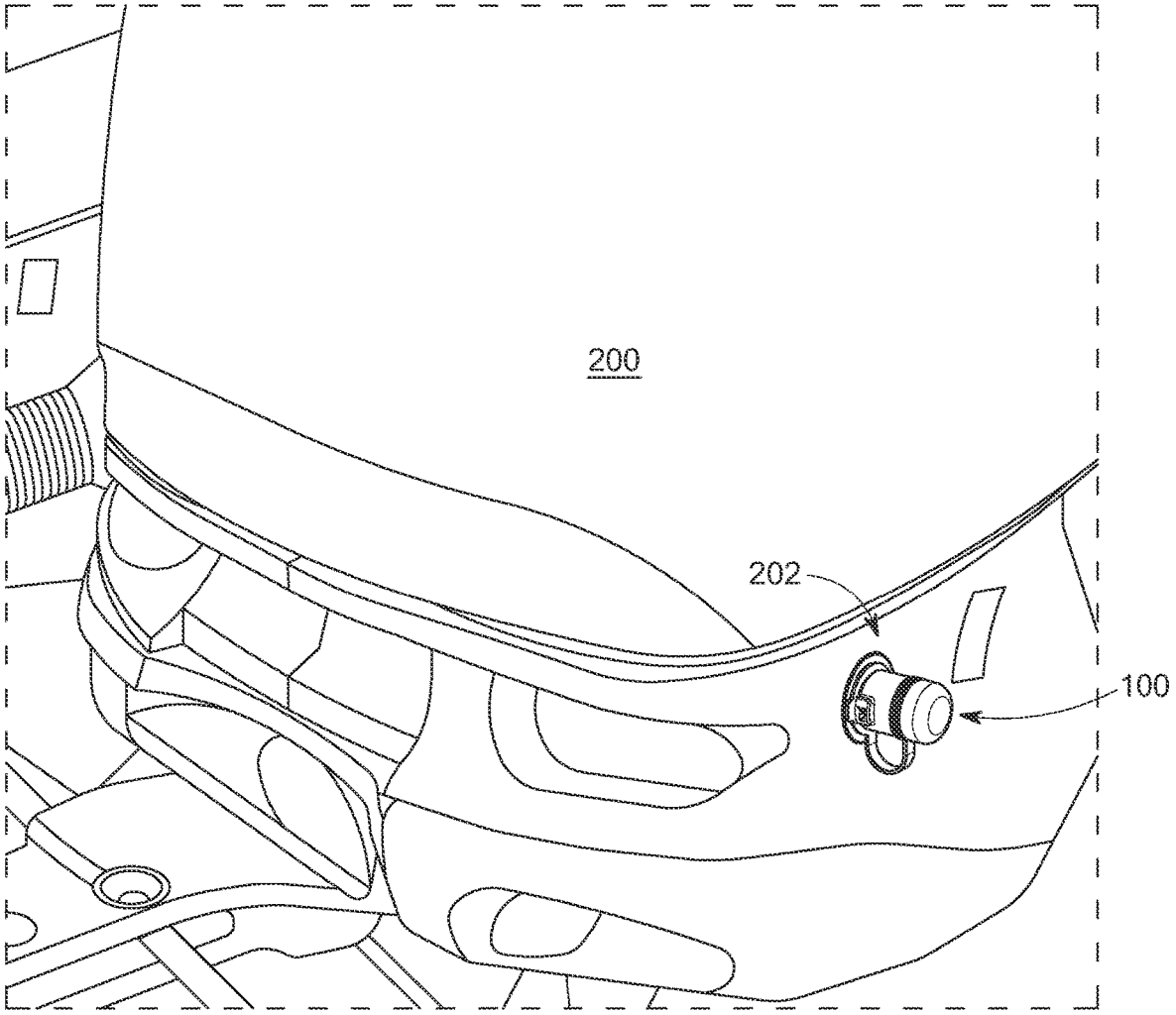
FIG. 4 illustrates a third isometric view, installed in an outboard motor of the outboard motor quick connect system.

Referring to FIG. 4, a third isometric view, installed in an outboard motor of the outboard motor quick connect system is shown.

The outboard motor quick connect system 100 is shown installed in the flush connection 202 of an outboard motor 200, in a closed position.

Figure 5:
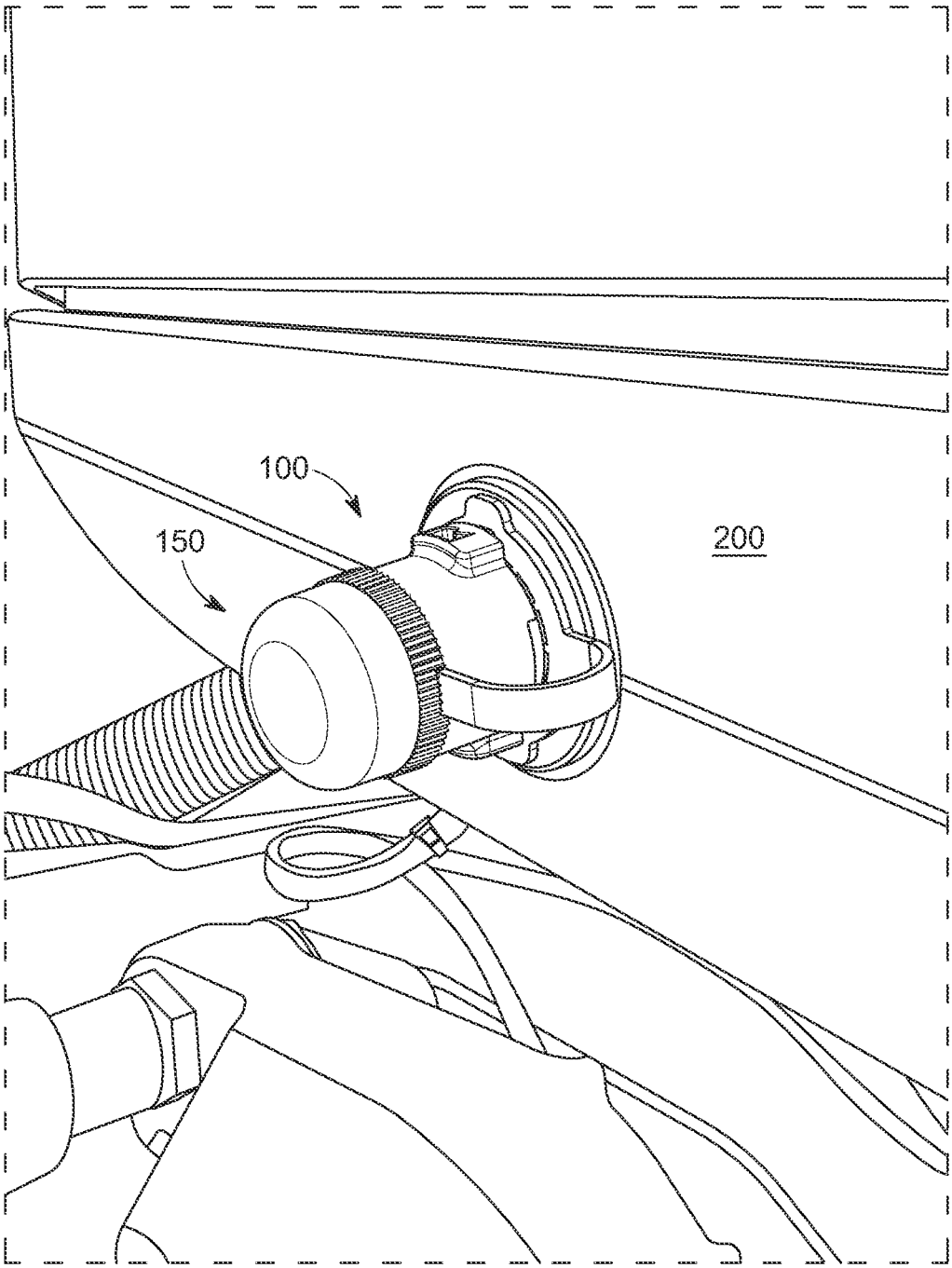
FIG. 5 illustrates a fourth isometric view, installed in an outboard motor of the outboard motor quick connect system.

Referring to FIG. 5, a fourth isometric view, installed in an outboard motor of the outboard motor quick connect system is shown.

The outboard motor quick connect system 100 is again shown installed in an outboard motor 200 in a closed position.

The motor-connection end 112 (see FIG. 1) is hidden within the outboard motor 200, leaving only the cap 150 visible.

Figure 6:
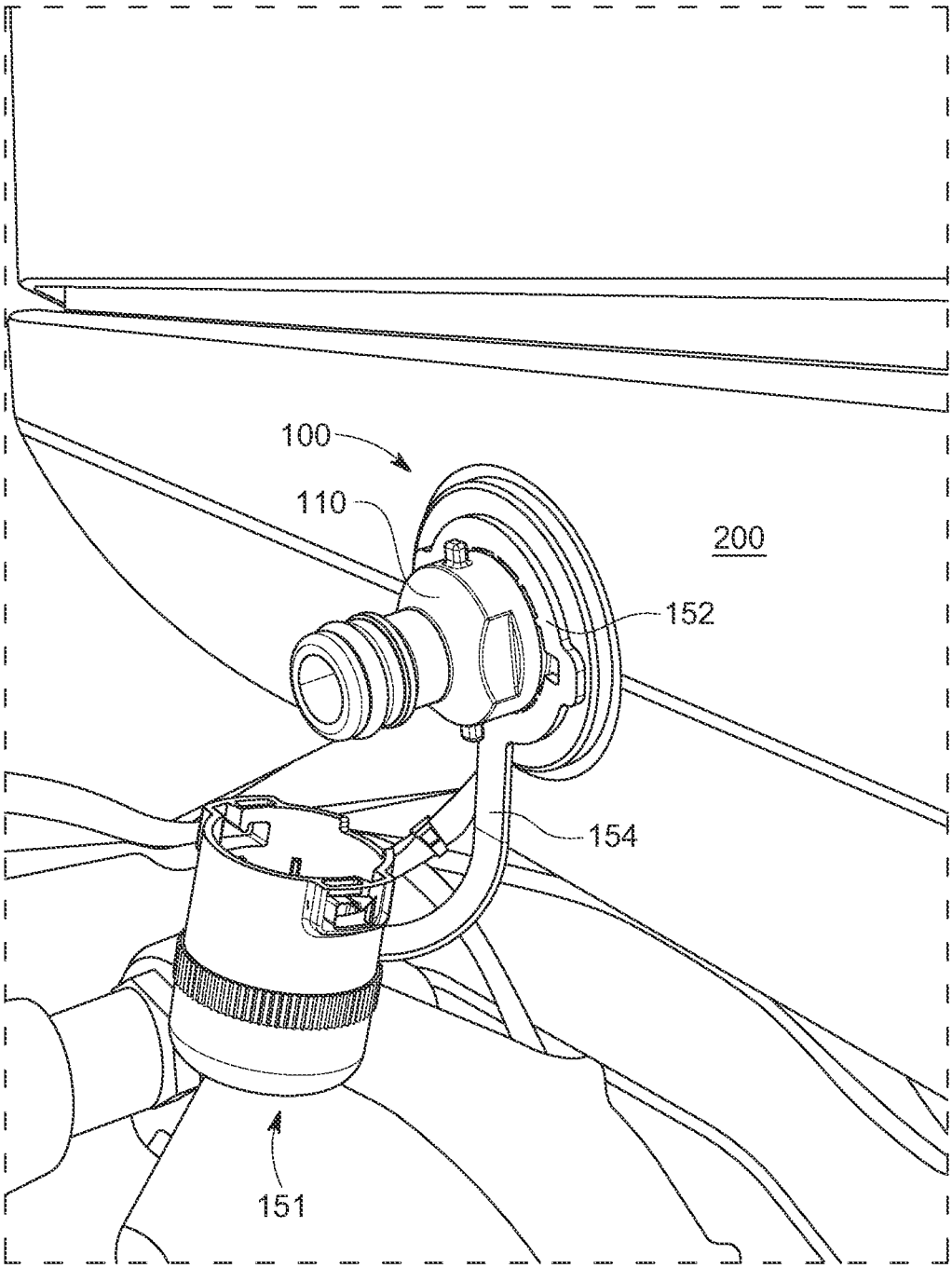
FIG. 6 illustrates a fifth isometric view, in an open position installed in an outboard motor of the outboard motor quick connect system.

Referring to FIG. 6, a fifth isometric view, in an open position installed in an outboard motor of the outboard motor quick connect system is shown.

The outboard motor quick connect system 100 is again shown installed in an outboard motor 200, but in an open position.

The motor-connection end 112 (see FIG. 1) is again hidden within the outboard motor 200, but in the open position the water flush connection 110 is visible, with the cap head 151 held by the retaining ring 152 and retaining leash 154.

Figure 7:
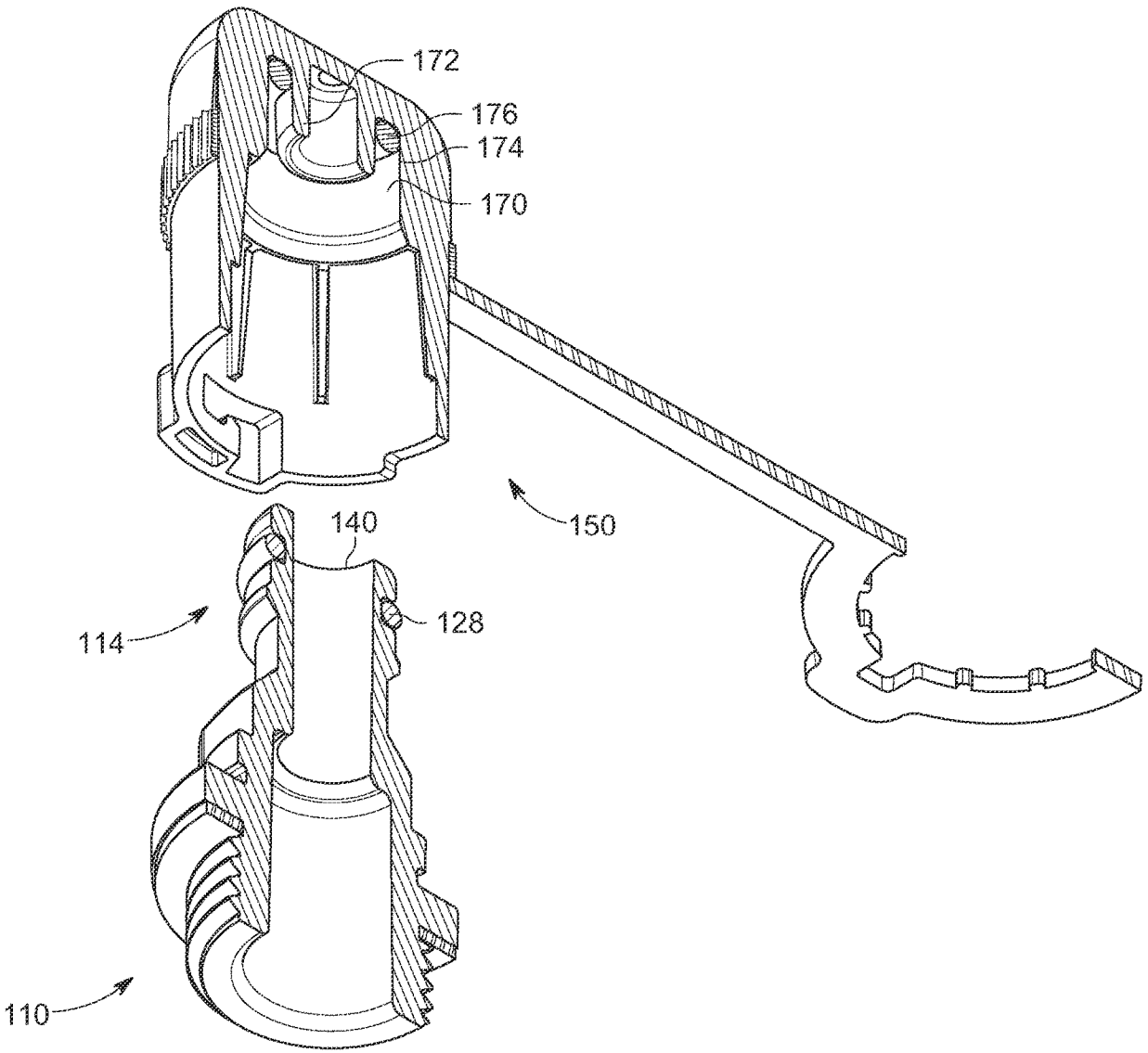
FIG. 7 illustrates an isometric cross-section of the outboard motor quick connect system.

Referring to FIG. 7, an isometric cross-section of the outboard motor quick connect system is shown.

Two types of compression are created when the cap head 151 is applied to the hose connection end 114. The recess O-ring 176 is compressed against the circular, ring-shaped tip 140 of the water flush connection 110. Thus, the recess O-ring 176 is compressed in height within the centering recess 170, or perpendicular to its largest dimension.

The flush connection O-ring 128 is compressed between the water flush connection 110 and the inner protrusion wall 174. Thus, the flush connection O-ring 128 is circumferentially compressed, or compressed toward the center of its circular shape.

These two types of compression work together to prevent leakage of water that would otherwise be exiting the outboard motor cooling system.

Figure 8A:
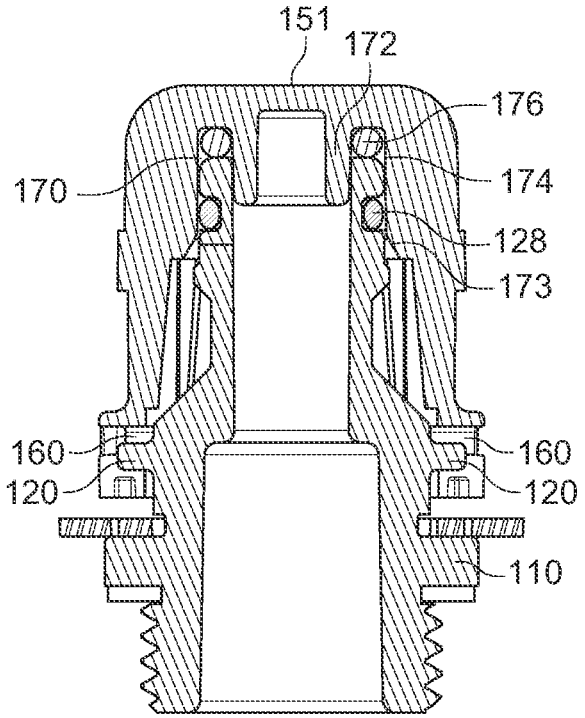
FIG. 8A illustrates a cross-section before locked in a closed position of the outboard motor quick connect system.
Figure 8B:
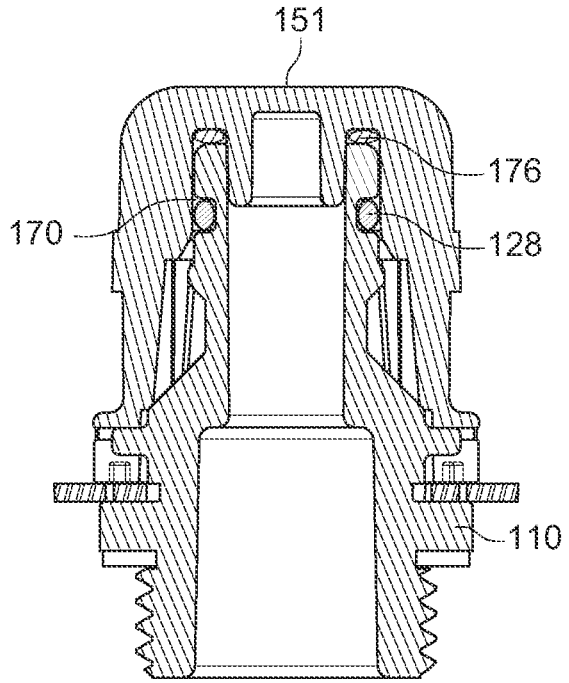
FIG. 8B illustrates a cross-section after locked in a closed position of the outboard motor quick connect system.

Referring to FIGS. 8A and 8B, a cross-section of the outboard motor quick connect system is shown as it moves from an unlocked to a locked position.

In FIG. 8A the cap head 151 has been applied to the water flush connection 110, the tabs 120 within the tab slots 160. The flush connection O-ring 128 within the centering recess 170 seals against the inner protrusion wall 174, but the recess O-ring 176 of the cap head 151 has not yet sealed.

As a note, the centering protrusion 172 includes a circumferential ramp 173 which helps the flush connection O-ring 128 to slide into position against the inner protrusion wall 174 as the cap head 151 is applied to the water flush connection 110.

In FIG. 8B, the cap head 151 has been depressed against the water flush connection 110, causing compression of the recess O-ring 176 between the centering protrusion 172 and the inner protrusion wall 174, compressing and creating a watertight seal.

The result is two seals that prevent water leakage through the connection during use of the outboard motor: flush connection O-ring 128 and recess O-ring 176.

Referring to FIGS. 9A through 9D, the cap is applied and sealed.

Figure 9A:
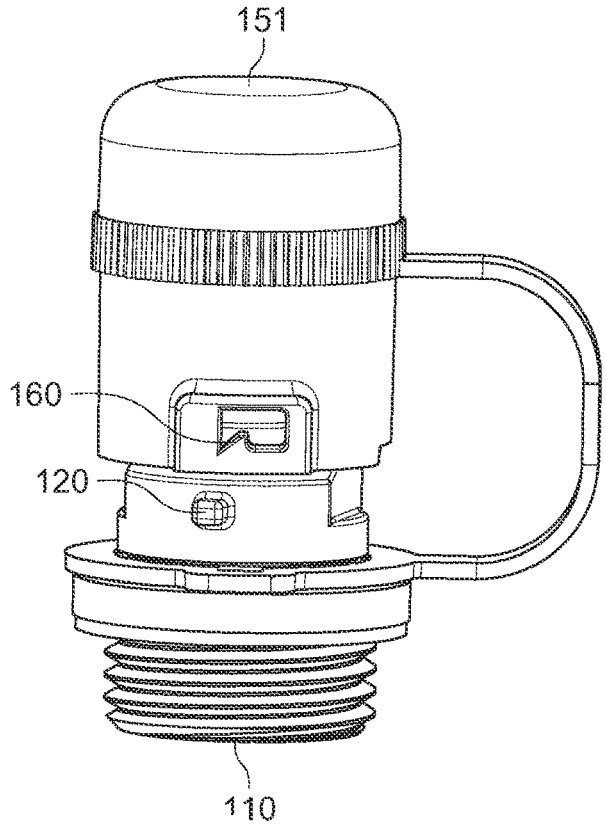
FIG. 9A illustrates a first side view, as the cap is applied, of the outboard motor quick connect system.

In FIG. 9A, the cap head 151 has been placed over the tip 140 (see FIG. 1) of the water flush connection 110.

Figure 9B:
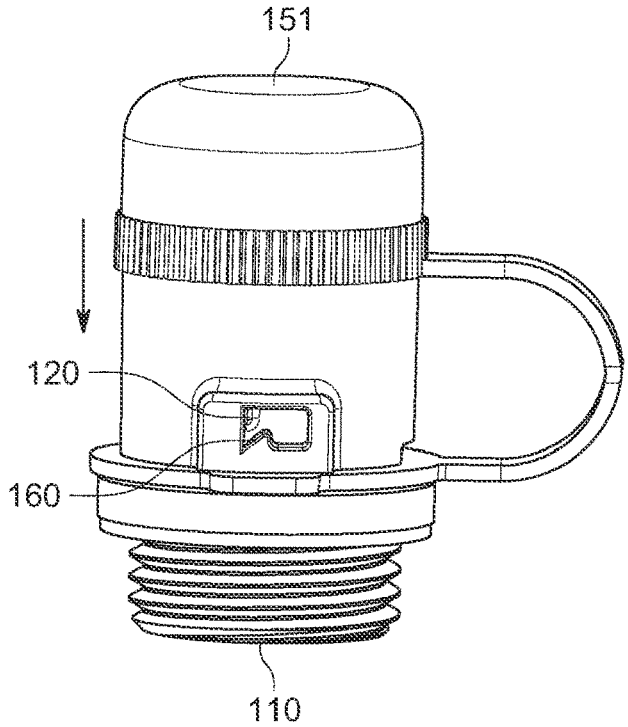
FIG. 9B illustrates a second side view, as the cap is pushed, down of the outboard motor quick connect system.

In FIG. 9B, the cap head 151 pushed down, the tab 120 passing through the tab slot 160.

Figure 9C:
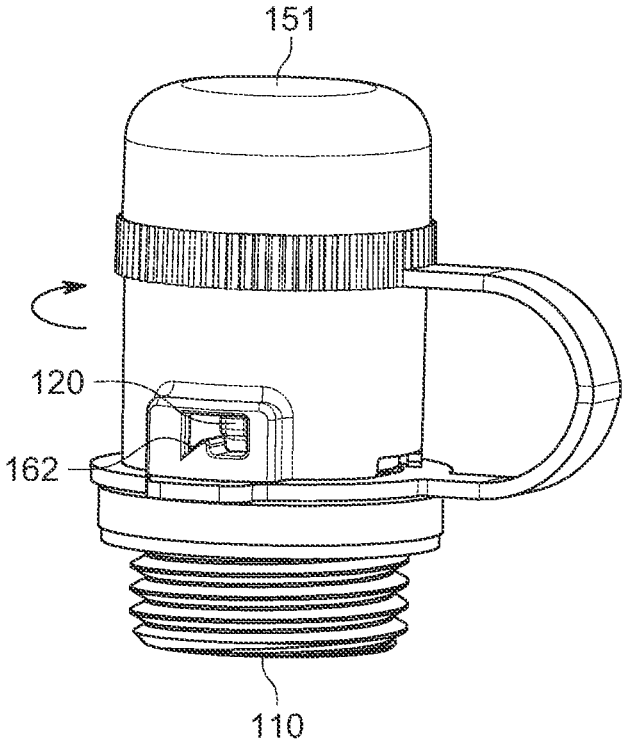
FIG. 9C illustrates a second side view, as the cap is rotated, of the outboard motor quick connect system.

In FIG. 9C, the cap head 151 has been rotated, moving the tab 120 across the tab tooth 162.

Figure 9D:
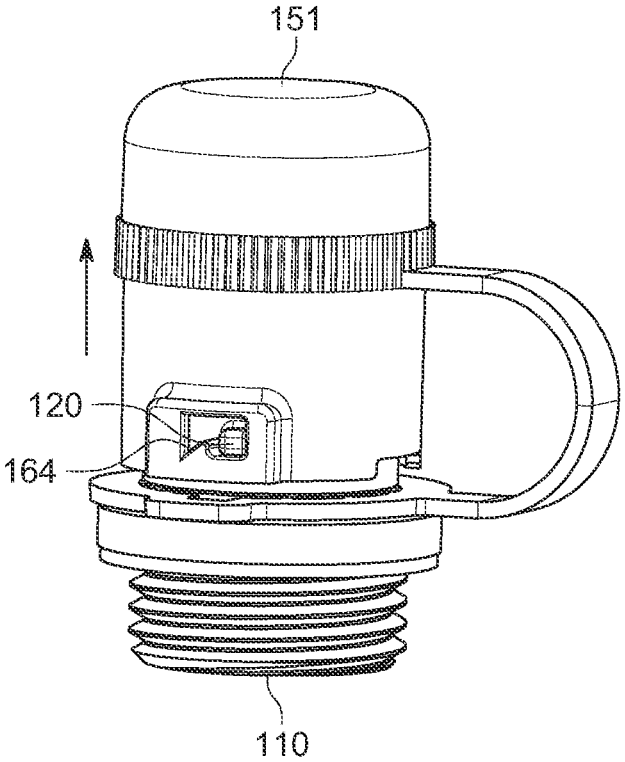
FIG. 9D illustrates a first side view, as the cap is released, of the outboard motor quick connect system.

In FIG. 9D, the cap head 151 has been released, allowing the tab 120 to rest within the tab retaining recess 164. In this position compression has been maintained of both the flush connection O-ring 128 (see FIG. 8B) and recess O-ring 176 (see FIG. 8B).

Figure 10:
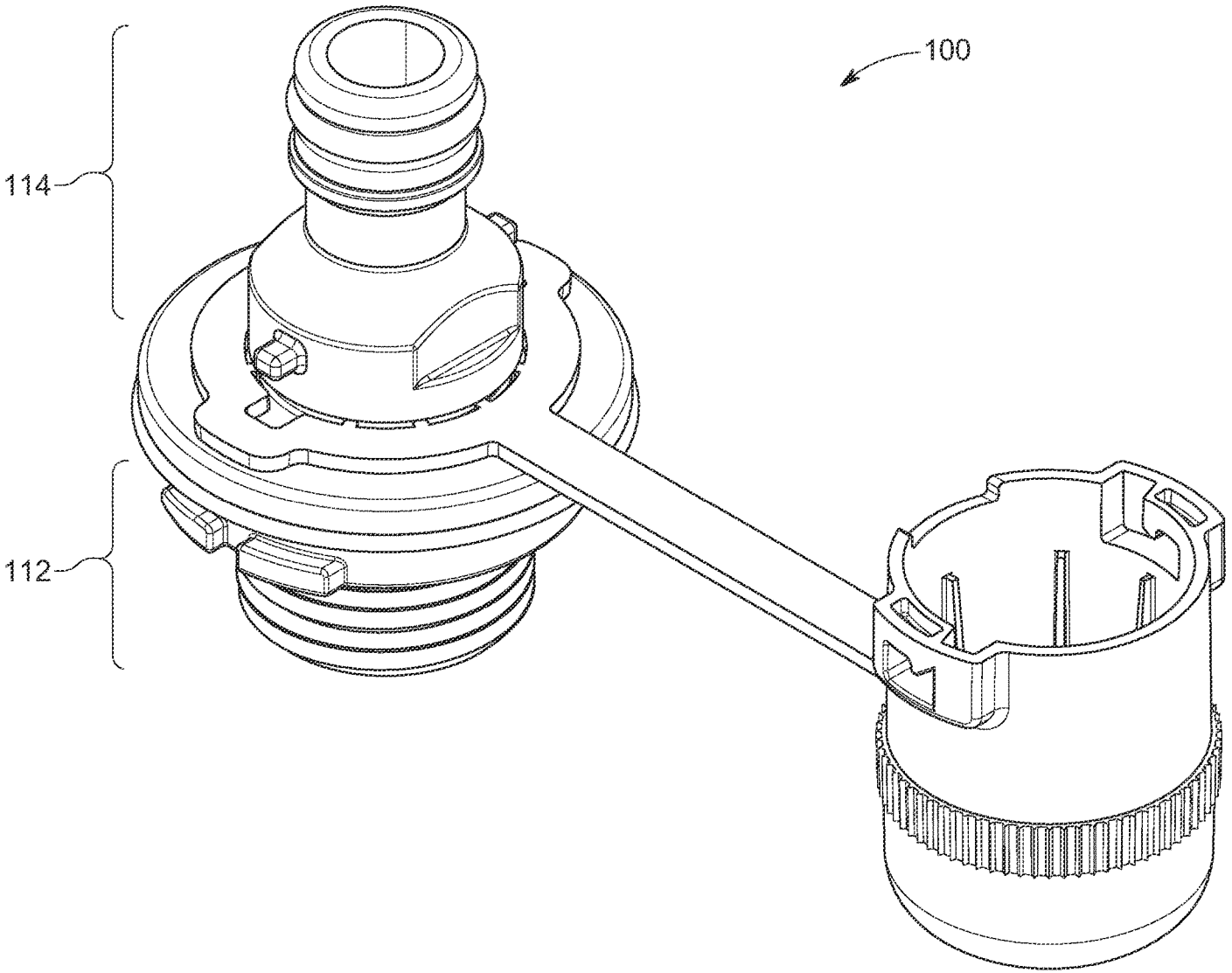
FIG. 10 illustrates an alternative embodiment of the outboard motor quick connect system.

In FIG. 10, an alternative embodiment of the outboard motor quick connect system 100 is shown with a modified motor connection end 112 to fit alternative outboard motors.

Equivalent elements can be substituted for the ones set forth above such that they perform in substantially the same manner in substantially the same way for achieving substantially the same result.

What is claimed is:

1. A flush connection device for use with an outboard motor cooling port, the device comprising:

a water flush connection;

the water flush connection including a hose connection end;

the hose connection end including a tip with a circular ring shape;

a cap;

a recess O-ring within a recess within the cap;

the hose connection end fitting into the cap;

mating of the cap and the hose connection end causing compression of the recess O-ring between the tip of the hose connection end and the recess within the cap;

a pair of tabs;

the pair of tabs protruding outward from the water flush connection;

the cap including a pair of tab slots into which the pair of tabs passes;

the pair of tabs passing into their respective pair of tab slots, rotation then passing each tab of the pair of tabs across a tab tooth, to rest within a tab retaining recess;

the tab retaining recess causing the cap to be held in a position that compresses the recess O-ring, thereby ensuring sealing of the cap against the water flush connection;

whereby compression of the recess O-ring prevents water from leaking out through the hose connection end.

2. The flush connection device for use with an outboard motor cooling port of claim 1, the water flush connection further comprising:

a motor connection end;

the motor connection end opposing the hose connection end;

the motor connection end including garden hose threads for interfacing with an outboard motor cooling port.

3. The flush connection device for use with an outboard motor cooling port of claim 1, further comprising:

a first tab and a second tab, each protruding outward from the water flush connection;

a first tab slot and as second tab slot, each within the cap;

the first tab slot including a tab groove, a tab tooth, and a tab retaining recess;

the first tab sliding through the tab groove as the cap is applied to the water flush connection, rotation of the cap with respect to the water flush connection causing motion of the first tab across the tab tooth and releasing of the cap causing the first tab to rest against the retaining recess;

interaction of the tab retaining recess and the first tab maintaining compression of the recess O-ring against the tip of the water flush connection and the recess within the cap thereby sealing the cap against the water flush connection.

4. The flush connection device for use with an outboard motor cooling port of claim 1, further comprising:

a flush connection O-ring surrounding the hose connection end of the water flush connection;

a combination of the flush connection O-ring and the recess O-ring creating a double seal to prevent leakage past the cap.

5. The flush connection device for use with an outboard motor cooling port of claim 1, further comprising:

a flush connection O-ring surrounding the hose connection end of the water flush connection;

a combination of the flush connection O-ring and the recess O-ring creating a double seal to prevent leakage past the cap.

6. A boat flush connector for use with an outboard motor, the boat flush connector to be left in place at all times, the boat flush connector comprising:

a water flush connection with a motor connection end and a hose connection end;

the hose connection end including a ring-shaped flat tip;

the hose connection end including a central bore, water allowed to flow through the central bore to flush the outboard motor;

a cap;

a centering recess within the cap;

a recess O-ring within the centering recess;

the ring-shaped flat tip of the hose connection end fitting within the centering recess, compressing the recess O-ring against the centering recess to create a seal;

a first tab and a second tab, each protruding outward from the water flush connection;

a first tab slot and as second tab slot, each within the cap;

the first tab slot including a tab groove, a tab tooth, and a tab retaining recess;

the first tab sliding through the tab groove as the cap is applied to the water flush connection, rotation of the cap with respect to the water flush connection causing motion of the first tab across the tab tooth and releasing of the cap causing the first tab to rest against the tab retaining recess;

interaction of the tab retaining recess and the tab maintaining compression of the recess O-ring against the ring-shaped flat tip of the water flush connection and the centering recess within the cap thereby sealing the cap against the water flush connection;

whereby connection of the cap to the water flush connection seals the water flush connection, preventing leakage during operation of the outboard motor.

7. The boat flush connector for use with an outboard motor of claim 6, the water flush connection further comprising:

a motor connection end;

the motor connection end opposing the hose connection end;

the motor connection end including garden hose threads for interfacing with an outboard motor cooling port.

8. The boat flush connector for use with an outboard motor of claim 6, further comprising:

a flush connection O-ring surrounding the hose connection end of the water flush connection;

a combination of the flush connection O-ring and the recess O-ring creating a double seal to prevent leakage past the cap.

9. A boat flush connection for use with an outboard motor, the boat flush connection having an unsealed position for motor flushing and a sealed position for motor operation, the boat flush connection comprising:

a cap and a water flush connection;

the cap for installation on a hose connection end of the water flush connection for motor operation;

the cap to be removed from the hose connection end of the water flush connection for motor flushing;

the cap including a centering protrusion with centering recess, and a recess O-ring;

a tip of the hose connection end of the water flush connection compressing the recess O-ring when the cap is installed, preventing leakage of water out of a cooling system of the outboard motor.

10. The boat flush connection of claim 9, further comprising:

a pair of tabs;

the pair of tabs protruding outward from the water flush connection;

the cap including a pair of tab slots into which the pair of tabs passes;

the pair of tabs passing into their respective pair of tab slots, rotation then passing each tab of the pair of tabs across a tab tooth, to rest within a tab retaining recess;

the tab retaining recess causing the cap to be held in a position that compresses the recess O-ring, thereby ensuring sealing of the cap against the water flush connection.

11. The boat flush connection of claim 9, the water flush connection further comprising:

a motor connection end;

the motor connection end opposing the hose connection end;

the motor connection end including garden hose threads for interfacing with an outboard motor cooling port.

12. The boat flush connection of claim 9, further comprising:

a first tab and a second tab, each protruding outward from the water flush connection;

a first tab slot and as second tab slot, each within the cap;

the first tab slot including a tab groove, a tab tooth, and a tab retaining recess;

the first tab sliding through the tab groove as the cap is applied to the water flush connection, rotation of the cap with respect to the water flush connection causing motion of the first tab across the tab tooth and releasing of the cap causing the tab to rest against the tab retaining recess;

interaction of the tab retaining recess and the first tab maintaining compression of the recess O-ring against the tip of the water flush connection and the tab retaining recess within the cap thereby sealing the cap against the water flush connection.

13. The boat flush connection of claim 9, further comprising:

a flush connection O-ring surrounding the hose connection end of the water flush connection;

a combination of the flush connection O-ring and the recess O-ring creating a double seal to prevent leakage past the cap.

14. The boat flush connection of claim 9, further comprising:

a flush connection O-ring surrounding the hose connection end of the water flush connection;

a combination of the flush connection O-ring and the recess O-ring creating a double seal to prevent leakage past the cap.

* * * * *